US006113418A

United States Patent [19]

Kjeldahl

[11] Patent Number: 6,113,418

[45] Date of Patent: Sep. 5, 2000

[54] CONNECTOR ELEMENT FOR TELECOMMUNICATION

[75] Inventor: Poul Kjeldahl, Skanderborg, Denmark

[73] Assignee: Cekan/CDT A/S, Denmark

[21] Appl. No.: 08/530,266

[22] PCT Filed: Mar. 11, 1994

[86] PCT No.: PCT/DK94/00107

§ 371 Date: Sep. 1, 1995

§ 102(e) Date: Sep. 1, 1995

[87] PCT Pub. No.: WO94/21007

PCT Pub. Date: Sep. 15, 1994

[30] Foreign Application Priority Data

Mar. 12, 1993 [DK] Denmark ..... 0281/93

[51] Int. Cl.[7] ..... H01R 9/11

[52] U.S. Cl. ..... 439/405; 439/941

[58] Field of Search ..... 439/395–405, 439/417–419, 885, 941, 676

[56] References Cited

U.S. PATENT DOCUMENTS

| | | | |
|---|---|---|---|
| 4,744,772 | 5/1988 | Reichardt et al. | 439/405 |
| 4,917,629 | 4/1990 | Matsuzaki et al. | 439/405 |
| 5,064,383 | 11/1991 | Locati et al. | 439/405 |
| 5,326,286 | 7/1994 | Bixler et al. | 439/405 |
| 5,586,914 | 12/1996 | Foster, Jr. et al. | 439/676 |

*Primary Examiner*—P. Austin Bradley
*Assistant Examiner*—Tho D. Ta
*Attorney, Agent, or Firm*—Wolf, Greenfield & Sacks P.C.

[57] ABSTRACT

A connector plug or jack element for a wire telecommunication system handling data with very high transmission capacity. A linear row of contact terminals is connected to wire connector terminals by leads internal to a cast block member which holds the leads in exact, fixed positions in a spatial or three-dimensional manner.

4 Claims, 3 Drawing Sheets

CONNECTOR ELEMENT FOR TELECOMMUNICATION

BACKGROUND OF THE INVENTION

The present invention relates to a connector plug or jack for use in communication networks, including data transmission networks. The traditional copper wires in these networks have been challenged by fibre optics, which provide a very high transmission capacity; that is, the ability of conducting a very high number of bits per second. However, the copper wire system still has pronounced advantages, and it has been possible to develop copper wire cables so as to achieve a noticeable increase of the transmission capacity. A main problem has been the electrical capacitance between the wires in a bundle of wires, but very good results have been achieved by different measures such as a twisting of the wires.

In connection with the invention, it has been recognized that in these systems there is a bottle neck problem associated with the use of the connector elements, in which it is common practice, derived from already established standards, to arrange neat rows of terminals which are connected with corresponding rows of cable connector terminals through parallel conductors inside the connector element. Inevitably, there will be a certain capacitive coupling between these conductors, and this coupling will be stronger, the smaller the distance is between the conductors. It is a pronounced desire that the connector elements should be as small as possible, and this, of course, will accentuate the problem, because the required small dimensions will imply a small mutual distance between the internal leads of the single connector elements, and thus a relatively high capacitance between these leads.

However, while the capacitance between neighbouring conductors is relatively high, it may be undesirably low between non-neighbouring conductors. The standard already set for the dedicated use of the single terminals are not too lucky for the favouring of ideal conditions in the connector elements, and problems occur not only as far as capacitance is concerned, but also with respect to conductor inductance and mutual inductance, the former being associated with the width of the conductors and the latter with the coil effect of the pairs of associated conductors.

SUMMARY OF THE INVENTION

The invention is believed to be a pioneer work in the study of the interactions of these different phenomena, but since the physical result of the invention seems to be structurally new, it is deemed unnecessary to describe the said phenomena in more detail. Of course, the structure of the invention has to be closely linked with the said, already established standards, but such standards may change, and the connector according to the invention may well be adapted to other standards.

In its basic concept, the invention breaks with the traditional picture of the leads inside the connector element extending practically parallel with each other between a row of connector terminals and a row of wire receiving terminals, in that these leads, internally in the connector unit, extend generally in a three-dimensional space, such that different leads are spaced not only laterally, but also perpendicularly to the plane of the lateral spacing.

As far as the capacitance is concerned, it is possible to hereby maintain a desired distance between two leads in the connector, while at the same time it is possible to bring more closely together two non-neighbouring leads increase the capacitance between them.

With respect to the mutual inductance, it will clearly make an important difference whether the coil axis is oriented one way or the other, and while the axis is conventionally located perpendicularly to the basic, common plane of the conductors, it will now be possible to turn the direction of the axis into a more or less inclined cross direction, by arranging for leads belonging to the same loops to be located one above the other, whether or not additionally being staggered in the transverse direction. The mutual inductance can be largely affected and controlled in this manner.

Also the inductance of the single leads can be adjusted, because once the leads are brought into a three-dimensional pattern they can be arranged generally with increased mutual distance, whereby their widths can be varied somewhat without any major influence on the capacitance.

In practice, of course, the sizes of the capacitance, the inductance and the mutual inductance will be highly interrelated in the structure, but in fact it has been found possible to design the lay-out in such a manner that the connector, seen electrically, simply disappears, causing no disturbance in the signal transmission, even at very high transmission capacities. The detailed lay-out will depend on the standards used for termination sequence and various electrical conditions, but given the conditions, the structure according to the invention will be widely adaptable thereto.

While the connector contact elements, normally made as strip end portions of the said internal leads, are desired—or prescribed—to be quite narrow and located in a row with small mutual spacing, the wire connector terminals cannot possibly be correspondingly arranged, as they have to be much broader. In a known connector as disclosed in U.S. Pat. No. 5,186,647, this problem is overcome by arranging the wiring terminals at both lateral sides of the connector, but this adds to the overall width of the connector. With the present invention, thanks to the spatial arrangement of the leads, it has been found possible to arrange these terminals in two rows, one behind the other in a lower level, whereby the total width of the connector can be kept small. Besides, it will be possible to mount all the wires by a single press-cap operation, if the terminals are of the type provided with upwardly open notches for receiving the wire ends and cutting into the sides of these ends.

BRIEF DESCRIPTION OF THE DRAWINGS

In the following, the invention will be described in more detail, with reference tto the drawing, in which.

Figure 1:
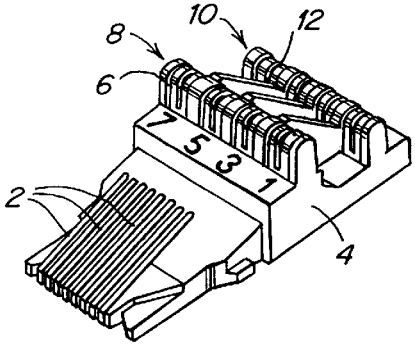
FIG. 1 is a perspective view of a connector unit according to the invention.
Figure 6:
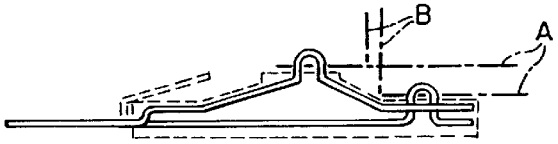
FIG. 6 is a side view of the leads, according to FIGS. 1 and 2, FIGS. 7 and 8 are cross sectional views showing different spatial dispositions of the leads.

The connector unit shown in FIG. 1, has eight contact springs 2 protruding at the front end of the connector and bent-over into their operative positions. See also FIG. 6 in which they are shown in dotted lines in that position. The leads of the connector are cast into a plastic block 4, in which the contact springs 2 are, respectively, connected with individual wire connector terminals 6 arranged in two rows, with four in each row, viz. a foremost high level row 8 and a rearmost low level row 10. Each of these inverted U-shaped terminals is provided with a notch 12 for receiving a horizontally disposed wire end, and on the conductor block 4 they are marked with the odd numbers from 1 to 7 at the higher row 8, and (as indicated in FIG. 3) with the even numbers from 2 to 8 at the lower row 10.

Figure 2:
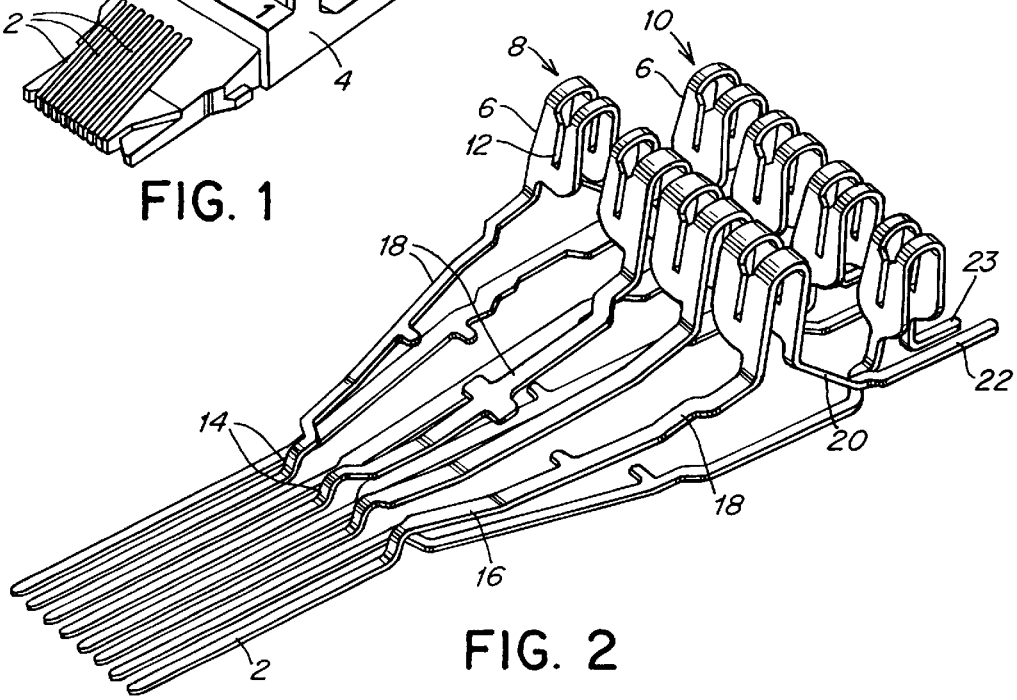
FIG. 2 is an enlarged perspective view of the internal leads of the connector, seen from the front end thereof.
Figure 3:
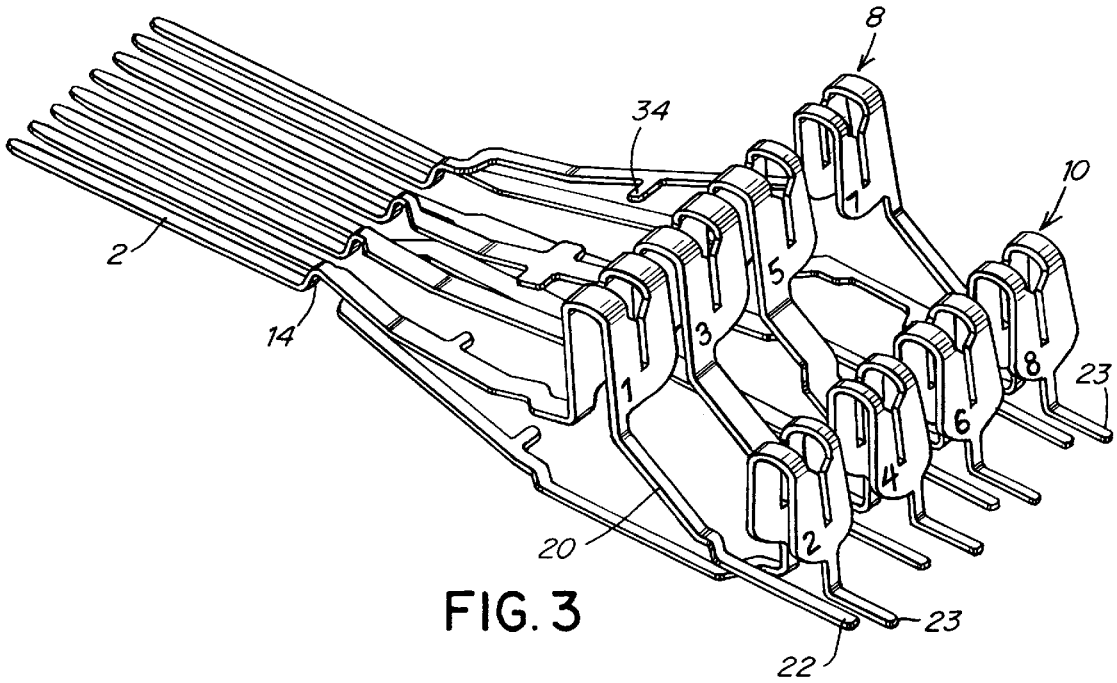
FIG. 3 is a similar view, seen from the rear end.

FIGS. 2 and 3 show the packing of leads as made ready for being cast into the body 4. The leads connecting the wiring terminals in the rear row 10 with their associated contact springs 2 extend in the plane of the forwardly projecting, not yet bent-over contact springs 2, while only the inverted U-shaped terminals 6 are provided as bent-up portions on these leads. At their roots adjacent to the contact springs 2, the other four leads are bent upwardly a short distance at 14, whereafter they extend rearwardly through a short horizontal stretch 16 and then further through an upwardly inclined stretch 18 to the inverted U-member forming the associated terminal 6 in the upper terminal row 8, and therefrom further rearwardly through a downwardly inclined stretch 20 and a following, rear stretch 22 almost level with the foremost horizontal stretch; i.e. somewhat spaced above the level of the lowermost leads. Also the lower terminals 6 have rearwardly projecting portions 23.

The FIGS. 2 and 3 will almost speak for themselves, but they will be further commented upon later on in the following.

Figure 4:
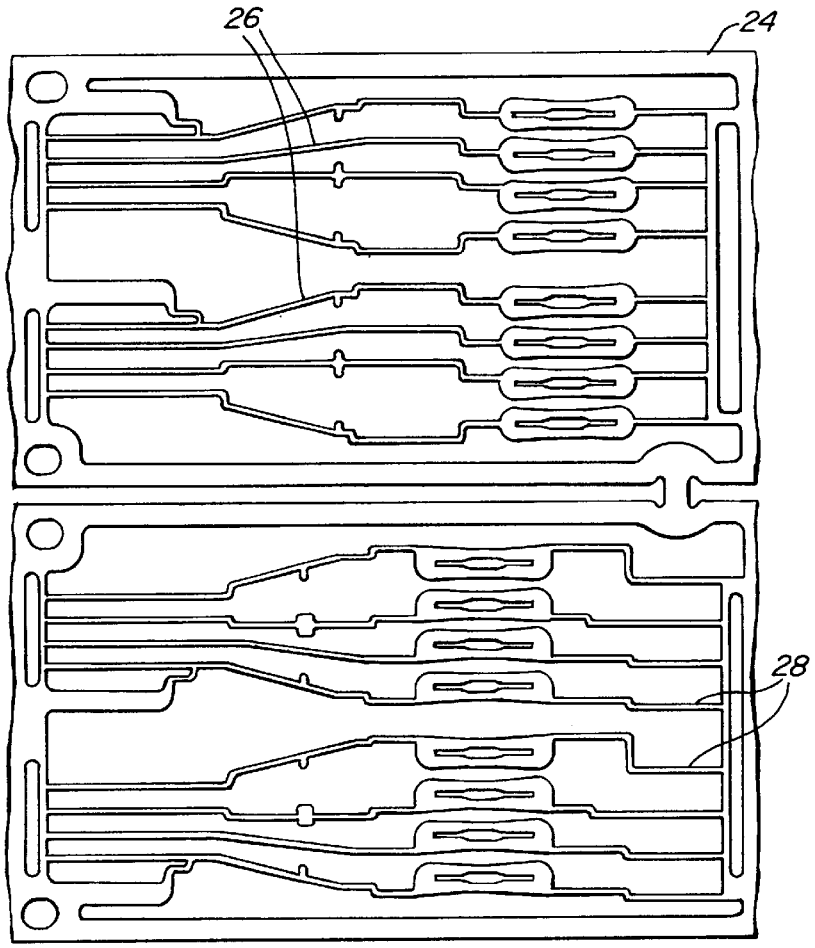
FIG. 4 is a plan view of a section of a punched strip member for forming the different leads in two layers.

The lead packing according to FIGS. 2 and 3 is made of two superimposed layers made, each, of four leads as illustrated in FIG. 4. This figure shows a section of a bronze strip 24, from which is punched, repeatedly, two bottom layers 26 and two top layers 28, which layers are then subjected to spatial shaping for the formation of the terminals 6 and the raised runs 18, 20 of the upper layer. Thereafter, the two different layers are consecutively superimposed and fed to an injection moulding machine, in which they are provided with the block 4 according to FIG. 1. The immediate result is shown in a more detailed view in FIG. 9, where the contact springs 2 are shown leaving the block 4 horizontally and with their outer ends interconnected by an integral cross strip 3 in each layer. After the moulding of the block 4 these cross strips are cut off, and the springs are bent over according to FIG. 1.

Figure 10:
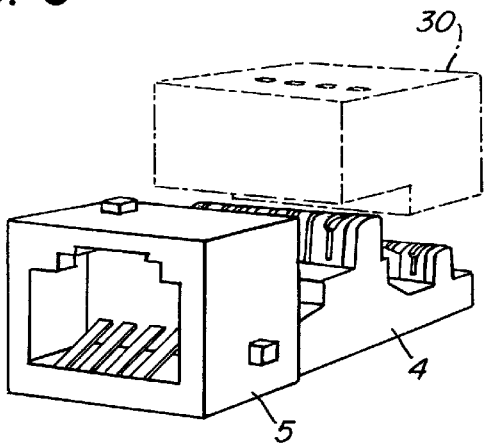
FIG. 10 is a perspective view of a finished connector, based on the unit shown in FIG. 9.

Thereafter, as shown in FIG. 10, the unit is provided with a front frame member 5, which is secured by snap locking into non-illustrated apertures in the underside of the foremost flat portion of the block unit 4.

Figure 11:
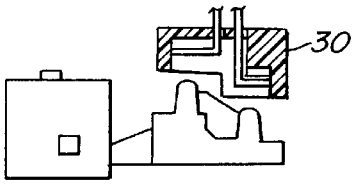
FIG. 11 is a sectional view of the unit.

In FIG. 10 is shown, in dotted lines, a press-cap member 30 which, according to known principles, may facilitate the mounting of the isolated connector wires in the self-cutting type of wiring terminals 6. For such a mounting it could be natural to insert the straight wire ends into orderly arranged holes at the rear side of the cap member, such that the wire ends would automatically be pressed down into the correct terminals when the cap is pressed down. However, the electrical conditions are very critical, and instead of prescribing such a mounting, see the wire pair A shown in dot-and-dash lines in FIG. 6, it is found better to arrange the wires as shown by the wire pair B in the same figure, i.e. let in through the top of the presscap 30. The reason is that wires A, particularly the uppermost wires, form loops together with the leads of the connector, and it will be noted from FIG. 6 that the areas of these loops will be considerably smaller for wires B than for wires A. The wires B are mounted in the press-cap as shown in FIG. 11.

In the example shown the connector is made according to a specific standard, according to which the different terminals as numbered 1–8 in FIG. 1 should be used in pairs for different circuits, these pairs being defined by the following terminals: 1–2; 4–5; 3–6; 7–8.

Figure 7:
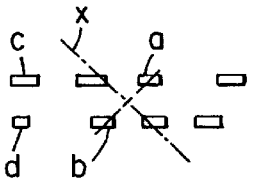

For at least one of these pairs it will be characteristic that the associated leads 18 will be located one above the other, such that the loop portion they form will have its cross axis located horizontally or in an oblique plane rather than vertically as in case of leads running in parallel side by side. This is illustrated in FIG. 7, where the two leads a and b form a coil portion having the field axis x. Another wire pair c, d is located in a vertical plane, thus having a horizontal loop axis. These field orientations are significant for the mutual inductance between the wire pairs.

It will be appreciated that from (or to) the tightly disposed contact springs 2, leads inside the connector are arranged in a very open structure. With the spatial arrangement the distance between the leads, generally, is largely increased, and it is possible to use leads of varying width in order to optimize the inductances for the desired result.

An important parameter to be balanced is the capacitance between the leads, both of the single pairs and the different pairs. Generally, the open structure conditions reduce the capacitance, but still there is a need for further reducing them at some places and for reducing them less at other places—or even increasing them. Also this can be regulated thanks to the spatial structure, as now explained with reference to FIG. 8.

Figure 8:
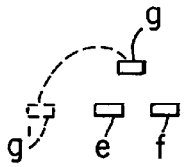

FIG. 8 shows three leads e, f and g arranged in a spatial, triangular pattern. They should be compared with a corresponding flat system, with lead g located in the position marked g'. In that situation the capacitance between g' and e, as well as between e and f, may be satisfactory, while it could be desired to increase the capacitance between g' and f. In a plane system this will be practically impossible without adversely affecting the other capacitances, but if in a spatial system the lead g' is swung along a circle centered in e, it will maintain its capacitance with e while increasing its capacitance with f. Thus, in position g it still has the desired capacitance with e, while its capacitance with f is increased as much as desired.

Correspondingly, it is desired to decrease the capacitance between g' and f, without changing the capacitance g' e, then e could be swung about g', away from f. Additionally, e may be arranged more or less close to g' for changing even this capacitance, and furthermore the widths of the leads will influence the capacitances.

Figure 5:
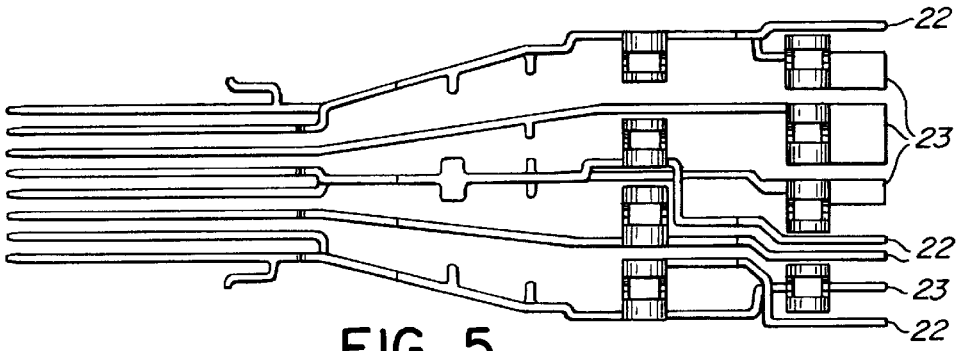
FIG. 5 is a top view of these layers when laid together.

Thus, also for this purpose it will be a characteristic feature that once at least one of the leads has attained a level above that of an underlying lead, as at the bent-up lead portions 14, FIG. 2, there will be a lateral displacement of the longitudinal extension of one of these leads, not only for forming a non-horizontal loop as already described, but additionally or alternatively for adjusting relevant capacitances in the neighbourhood. Hereby the leads might even cross each other in different planes, but so far no such crossings have been found required, while—as particularly clear from FIG. 5—it is found advantageous and possible to let the leads extend predominantly in pairs with the leads located one directly above the other. As reflected by FIG. 5, however, there is used five lead paths due to uneven horizontal spacing between leads in the two layers. As to some other details, FIG. 5 shows another design, in which for example, the rear portions 22, 23 are of different widths.

Figure 9:
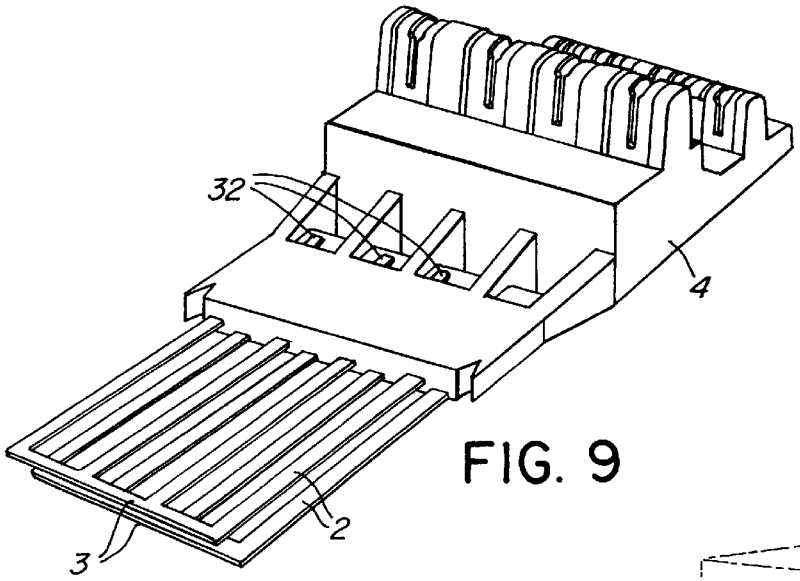
FIG. 9 is a perspective view corresponding to FIG. 1, but showing the unit in a more detailed manner.

From FIG. 9 it is apparent that some lead portions, designated 32, are exposed on the cast body 4. Such exposed areas also occur at the underside of body 4. With a view to the optimizing of the dielectrical coverage of the leads at any place thereof.

Once the detailed structure of the lead system has been determined and reduced to practice, i.e. stamped out and spatially shaped, it will normally be a very delicate matter to transfer the lead structure to the die casting machine, since the accuracy requirements will be extremely high. Thus, deviations or deformations of just some hundredths of a millimetre may make the connector unusable for the qualified purpose. On this background the lead system is provided with various portions such as protrusions 34, FIG. 3, and rear extensions 20, 22 from the upper row 8 of terminals 6, such that these portions can be gripped by suitable transfer means. The presence of these electrically non-required portions will call for special attention in the design of the system, because they will inevitably affect at least some of the operationally relevant parameters.

The connector shown is a female jack or socket member for receiving a counterpart made as a plug with rigid connector terminals. It will be understood that such a plug may be designed widely similar to the disclosed jack or at least according to the same principles with respect to the spatial arrangement of the leads.

Many modifications will be possible within the scope of the invention, not only as far as the detailed design of the illustrated leads is concerned. From a practical point of view it is desirable that the leads in the lower level extend in a common plane viz. The bottom plane also comprising the originally punched-out contact springs 2 according to FIGS. 1 and 2, but it will be an open possibility that these leads, or some of them, might extend otherwise, upwardly or downwardly. The same is true for the row of upper leads, which should not necessarily be located in a common plane. Even the terminals 6 will not have to be provided in line or level with each other; for the electrical adaptation, there could be good reasons for arranging them otherwise, but it will be appreciated that it is indeed practical to have them arranged in neat rows. Besides, it is highly advantageous that these terminals, which are potential high-capacitance units, can be separated in the longitudinal direction, while in the transverse direction they can be allowed to have a considerable, mechanically required width, without making the entire width of the connector element excessive. Besides, as also apparent from the Figures, the terminals in the single rows may be non-uniformly interspaced.

The two or even more rows of wire connection terminals 6 may thus be located otherwise than as shown, and so may the contact strips 2, which should not necessarily be arranged in one neat row.

What is claimed is:

1. A connector jack or plug element for electrical conductors in a high frequency communication network, said connector element including:

a linear row of contact terminals for connection with corresponding terminals of a mating plug or jack element;

a plurality of wire connector terminals;

internal leads in the connector element connecting the wire connector terminals with the contact terminals;

a cast block member of a dielectric material enclosing the internal leads and holding the internal leads of the connector element in fixed positions in a three-dimensional manner such that at least some of the internal leads are mutually spaced not only laterally but also cross-wise to the lateral spacing, wherein the internal leads are arranged generally in two layers, with the contact terminals of one layer of internal leads located flush and interlaced with the contact terminals of another layer of internal leads, the internal leads in each layer extending in a forward direction from said wire connector terminals at a rear end of the connector element to the contact terminals at a front end of the connector element, and wherein a bottom layer of the internal leads extends from a lower row of said wire connector terminals in a generally planar manner, and has upwardly bent wire terminal loops near the rear end of the connector element, and a top layer of the internal leads extends generally upwardly over the bottom layer of internal leads up to an upper row of wire connector terminals above and in front of the wire connector terminals of said bottom layer, and extends further rearwardly and downwardly towards the rear end of the connector element.

2. A connector jack or plug element for electrical conductors in a high frequency communication network, said connector element including:

a linear row of contact terminals for connection with corresponding terminals of a mating plug or jack element;

a plurality of wire connector terminals;

internal leads in the connector element connecting the wire connector terminals with the contact terminals;

a cast block member of a dielectric material enclosing the internal leads and holding the internal leads of the connector element in fixed positions in a three-dimensional manner such that at least some of the internal leads are mutually spaced not only laterally but also cross-wise to the lateral spacing, wherein the internal leads are arranged generally in two layers, with the contact terminals of one layer of internal leads located flush and interlaced with the contact terminals of another layer of internal leads, the internal leads in each layer extending in a forward direction from said wire connector terminals at a rear end of the connector element to the contact terminals at a front end of the connector element, and wherein at least one internal lead extends rearwardly from an associated contact terminal projects upwardly with respect to a neighboring internal lead, laterally to a position overhead the neighboring internal lead and projects rearwardly overhead and vertically diverging from the neighboring internal lead.

3. A method of manufacturing a connector element comprising:

(a) bringing together two layers of endwise interconnected, punched-out leads, one layer being substantially planar, except for bent-up wire terminal portions on the single leads, the other layer having leads extending upwardly to diverge from the leads of the one layer, (b) incorporating the leads in an injection molded block member to anchor the leads, and (c) cutting away the interconnecting portions between the lead ends.

4. A method according to claim 3, in which:

step (a) includes arranging the wire connector terminals so as to be located in interspaced transverse rows, provided with rearmost transverse connection portions, and step (c) includes cutting away the rearmost transverse connection portions.

* * * * *